US005421523A

United States Patent [19]

McMahon

[11] Patent Number: 5,421,523

[45] Date of Patent: Jun. 6, 1995

[54] PHYSIO-CHEMICAL COMMUNICATION WITH EXPANSIVE SOLIDIFIERS

[76] Inventor: David J. McMahon, 662 Key Route Blvd., Albany, Calif. 94706

[21] Appl. No.: 178,034

[22] Filed: Jan. 6, 1994

Related U.S. Application Data

[63] Continuation-in-part of Ser. No. 994,265, Dec. 21, 1992, abandoned.

[51] Int. Cl.[6] ..... B02C 19/12

[52] U.S. Cl. ..... 241/1; 241/17; 241/23; 299/10

[58] Field of Search ..... 241/1, 17, 23, 28, 65; 299/10

[56] References Cited

U.S. PATENT DOCUMENTS

| | | | |
|---|---|---|---|
| 3,3,508,613 | 4/1970 | Huff et al. | 241/1 X |
| 4,501,818 | 2/1985 | Rossi | 501/1 |
| 4,600,154 | 7/1986 | Hiroth et al. | 241/1 |
| 4,760,966 | 8/1988 | Finnegan et al. | 241/1 |
| 4,771,930 | 9/1988 | Coblonz et al. | 241/1 |
| 4,893,756 | 1/1990 | Fotlrnko et al. | 241/1 X |
| 4,934,608 | 6/1990 | Sylla et al. | 241/1 |
| 4,952,243 | 8/1990 | Kobayashi et al. | 241/1 X |
| 5,072,886 | 12/1991 | Morrison et al. | 241/1 |

*Primary Examiner*—Douglas D. Watts

[57] ABSTRACT

The physio-chemical method to break down raw materials utilizes a pressure- and temperature-controlled vessel to hold the raw materials in an expansive solidifier solution. The pressure and temperature are cycled to create large solution volume increases, to create high supersaturation ratios with reset to the hydrated phases of the salt or other chemicals, to produce rapid precipitation of the hydrated form of the salt or other chemicals from a supersaturated solution, and to produce rapid volume increases in the solution system. The rapid volume increases in the system create undrained crystallization pressures within the raw materials that break down the raw materials in to smaller pieces with higher surface area.

42 Claims, 3 Drawing Sheets

PHYSIO-CHEMICAL COMMUNICATION WITH EXPANSIVE SOLIDIFIERS

This is a continuation-in-part of Ser. No. 07/994,265, filed Dec. 21, 1992, which is now abandoned.

FIELD OF INVENTION

This invention is an improved physio-chemical method to break down raw materials into smaller pieces with a higher surface area.

BACKGROUND OF THE INVENTION AND DISCUSSION OF PRIOR ART

Heretofore, three broad classes of methods have been used to break down materials into smaller pieces: mechanical methods, chemical methods, and physio-chemical methods.

Mechanical methods made use of hammers, crushers, grinders, roll mills, ball mills, jet mills, and other impact or pressure devices to break raw materials into smaller pieces. For example, a rock crusher would be used to break boulder-sized rock into sand and gravel, or a grinding mill or chipper would be used to break raw lumber into wood chips. These methods were loud, resulted in high wear and tear on the mechanical equipment, and were energy intensive. They also had a limited size range, i.e. a rock crusher would not be effective at producing colloidal-sized particles; a wood chipper could not make chips much finer than sawdust; a jet mill would not be effective at breaking down boulder-sized rocks.

Chemical methods made use of chemical reactions to break raw materials into smaller pieces by reacting chemically with the raw materials, or by producing expansive or explosive chemical reactions to break apart the raw materials. The chemical methods that reacted chemically with the raw materials were limited by the surface area of the raw materials, and therefore often were combined with other mechanical or chemical methods to achieve the desired result, i.e. a wood chipper would be used to break raw lumber into sawdust prior to using chemical reactions (the "Kraft" method) to remove lignin from cellulose to produce paper pulp. Many chemical reactions resulted in unwanted toxic or hazardous by-products, which often resulted in pollution or high disposal costs. Once the chemical reactions had taken place, the reactants were used up and could not be re-used or easily recycled. Expansive or explosive chemical reactions had a limited size range, i.e. dynamite could be used to quarry rock, but would not be effective at producing colloidal-size particles. Explosive reactions were often noisy and the shock waves from the explosives resulted in sometimes dangerous or annoying vibrations being felt at some distance from the explosion. Once the explosive reactions were complete, the explosives could not be re-used. In addition, explosive chemical reactions are inherently dangerous. All of these problems often resulted in special permitting requirements in order to protect the public from pollution from chemical methods or the dangers of explosives, all of which increased the costs associated with their use.

Several physio-chemical methods have been used to comminute raw materials. One physio-chemical method has been previously used to break down raw materials down into smaller pieces: freezing and thawing. For example, holes were drilled into native rock, filled with water, the filled holes were plugged, and then the water was frozen. The 9 percent volume increase when water freezes to ice resulted in pressure within the drilled holes and tensile stresses within the native rock. When several holes were strategically placed in a linear pattern, the combined tensile stresses within the native rock resulted in splitting along the line. However, freezing is a relatively slow method, so plugs were required to prevent drainage which would otherwise have relieved any pressures that built up during freezing. In addition, freezing the water called for waiting for a period of freezing weather, or in bringing the temperature of a large mass of rock or other materials to freezing temperatures. Whether applied to rock or other materials, these methods were wasteful of time and/or energy.

Another physio-chemical method of comminution is heat-treatment, as exemplified by U.S. Pat. No. 4,501,818, for hydrothermal comminution of zirconia or hafnia. Heat-treatment combined with hidriding is described by U.S. Pat. No. 4,760,966, for comminuting rare earth magnet alloys. These types of materials are difficult to comminute with mechanical methods because of the toughness of the raw materials. These methods rely on heating and cooling the raw materials or on volume changes caused by chemical reactions with the raw materials to induce stresses within the raw materials of sufficient magnitude to result in comminution. These methods are suited for a limited number of materials and are cost-effective for limited size ranges of raw materials and comminuted product.

Another physio-chemical method of comminuting non-swelling clay minerals consists of applying intercalation-forming products to the minerals, as described by U.S. Pat. No. 3,508,613. Negatively-charged clay minerals adsorb positive cations, which attract polar water molecules, resulting is swelling. This method is appropriate for clay minerals only.

Accordingly, the objects of the invention are to break down raw materials with physio-chemical methods that are quieter, recyclable, non-explosive, more energy efficient, safer, result in less mechanical wear, and which are effective over a wide range of sizes and types of raw materials.

DRAWINGS

DESCRIPTION

Figure 2:
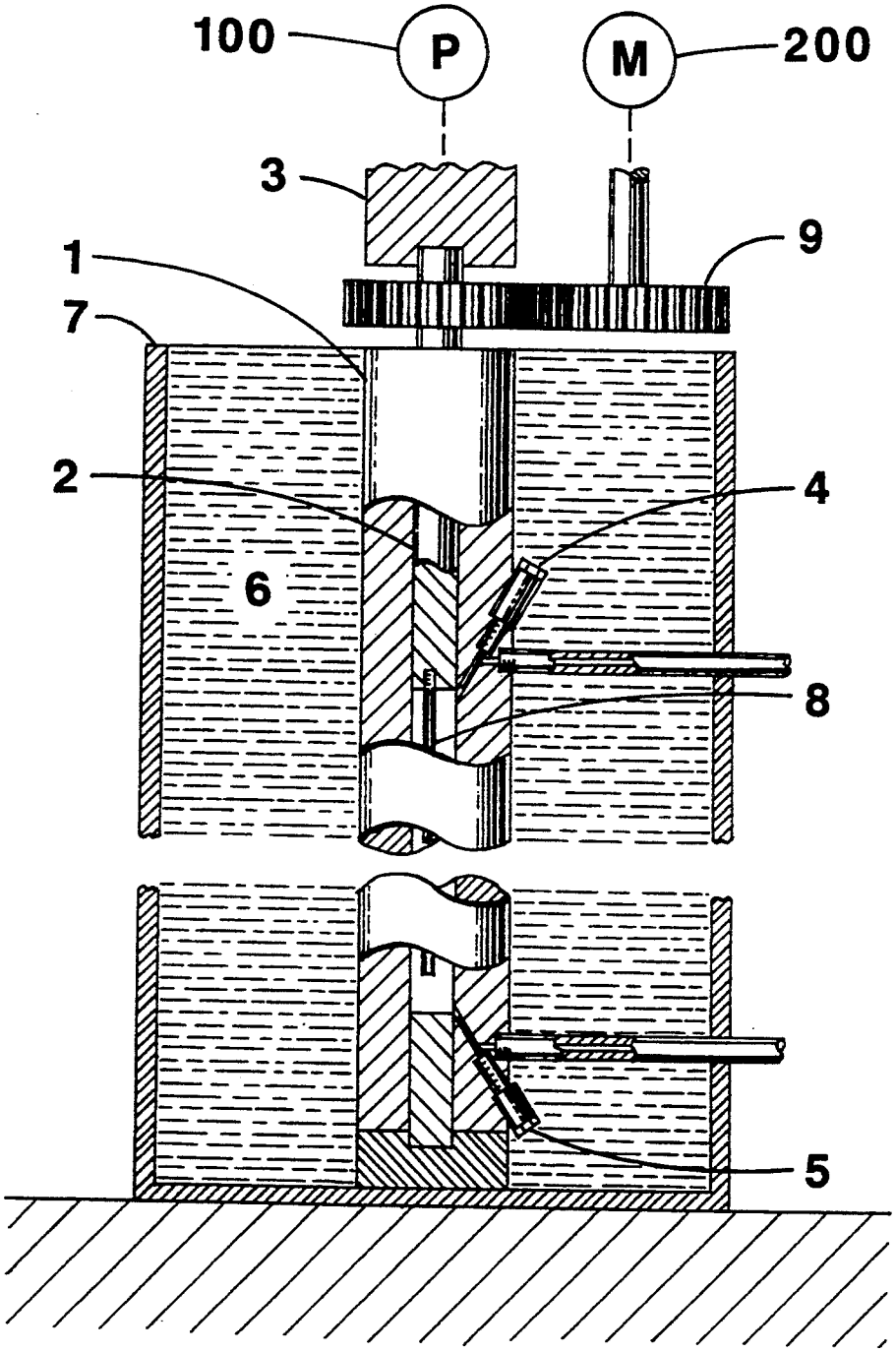
FIG. 2 is a temperature- and pressure-controlled vessel.

The machinery utilized for this method consists of a temperature- and pressure-controlled vessel, an example of which is shown in FIG. 2. The pressure vessel 1 is fitted with a piston 2, activated by a press 3. Raw materials are added and removed at the top of the pressure vessel 1 by removing the piston 2. A gas valve 4 is located near the top of the vessel, where gases are likely to accumulate. A solution valve 5 is located near the bottom of the pressure vessel 1 for removing and adding solutions.

The pressure in the pressure vessel 1 is controlled by applying pressure with the press 3 to the piston 2. Press 3 is operable for example hydraulically by pump 100 in a manner well known in the art. Temperature in the pressure vessel is controlled by water or other liquid 6 in the tank 7. Materials placed within the pressure vessel may be stirred by an agitator 8, which is threaded to the bottom of the piston 2. The agitator 8 is aligned toward one side of the piston 2, and therefore rotates along a circular path when turned by spur gears 9 run by a motor 200, thereby agitating the processing materials and materials to be processed.

Figure 3:
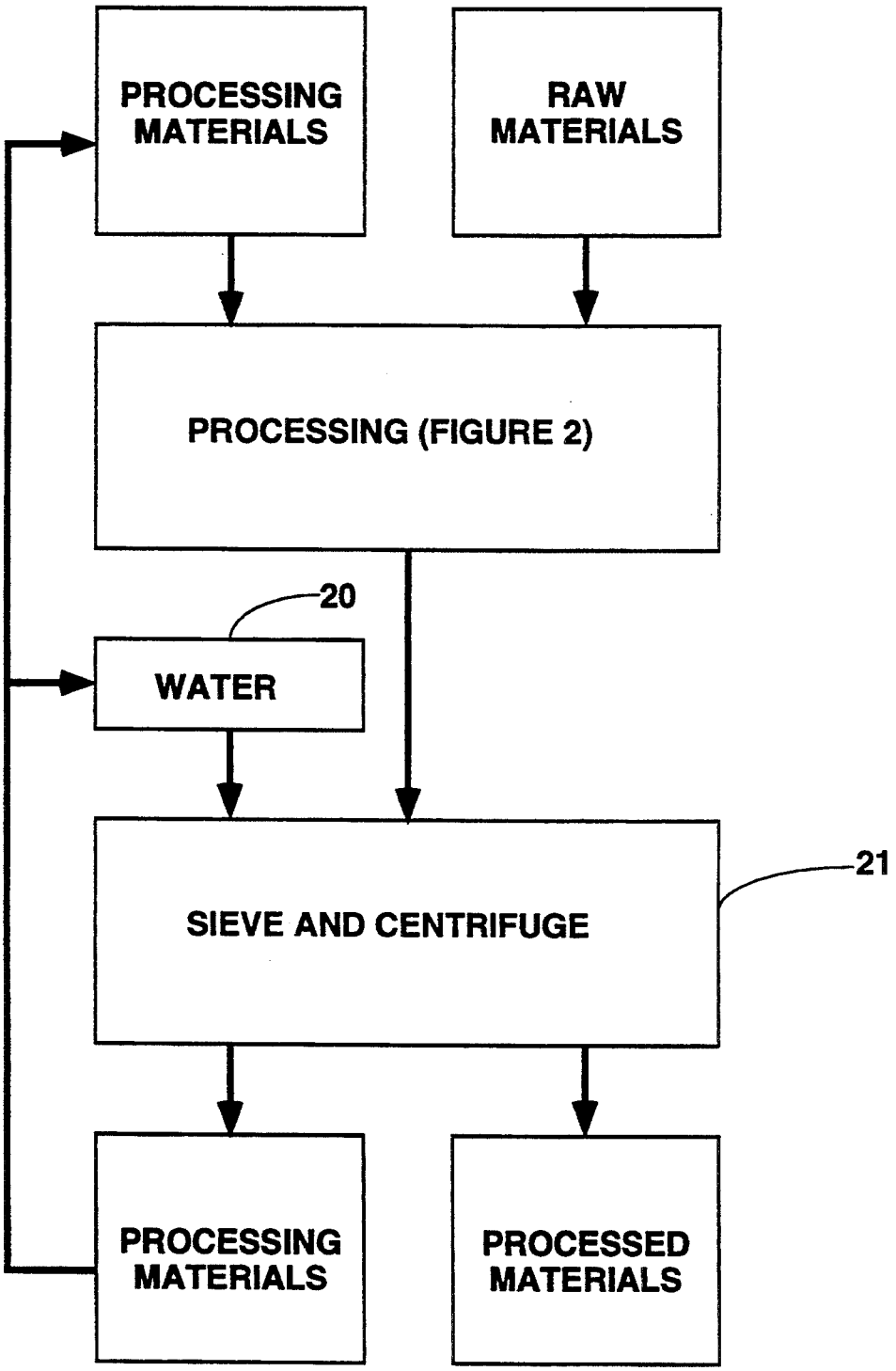
FIG. 3 shows a block diagram of recycling of the processing materials.

Processed materials may be washed 20, and then sieved and centrifuged 21 to separate the processing materials from the processed materials, as shown in FIG. 3.

The processing materials include water and any of various salts that have hydrated phases which have a higher volume when in solid form than when in solution.

The raw materials to be broken down may consist of any material containing voids, fractures or other pores.

OPERATION

Very few liquids expand when they solidify. Some exceptions include Babbitt metals (used in typesetting and other strain compensating metal uses), water and hydrates. In the case of water and hydrates, the expansion is the result of the polar nature of the $H_2O$ molecule. No generic term for these types of materials exists, and therefore they are hereby defined as and hereinafter called expansive solidifiers.

The physio-chemical method of breaking down raw materials into smaller pieces utilizes the crystallization of expansive solidifiers from a supersaturated solution to physically break apart the raw materials.

The precipitation of expansive solidifiers from highly supersaturated solutions can be a rapid process, with the highest rates of precipitation and volume increases occurring with increasing supersaturation. For example, in the sodium sulfate-water system where supersaturation is achieved by temperature changes, precipitation of mirabilite from a highly supersaturated solution of sodium sulfate is an almost instantaneous process and causes a theoretical volume increase of up to about 5 percent of the solution volume. This volume increase has been measured at up to about 3 percent of the solution volume when supersaturation was achieved by temperature changes.

Very rapid volume increases during precipitation from a supersaturated solution result in undrained crystallization pressures, which, when occurring within porous materials such as wood chips, rock, ore, coal, or any other porous materials, cause tensile stresses within the materials. The tensile stresses physically break apart the materials and increase the surface area. The primary chemical reaction is the phase change of the expansive solidifier from a solution to a solid, such as from a sodium sulfate solution to mirabilite (although other chemical reactions may occur depending on the solution and raw materials). Hence, the method is a physio-chemical method rather than a chemical method involving chemical reactions with the raw materials.

This physio-chemical method for one possible salt hydrate and its effects on concrete is described by McMahon et al (1992). In this reference and in the laboratory tests described therein, supersaturation in the sodium sulfate system was achieved by only rapidly decreasing the temperature with no significant change in pressure. Alternatively, pressure or combinations of pressure and temperature changes can be used to achieve high supersaturation ratios, high precipitation rates, and rapid breakdown of raw materials.

Figure 1:
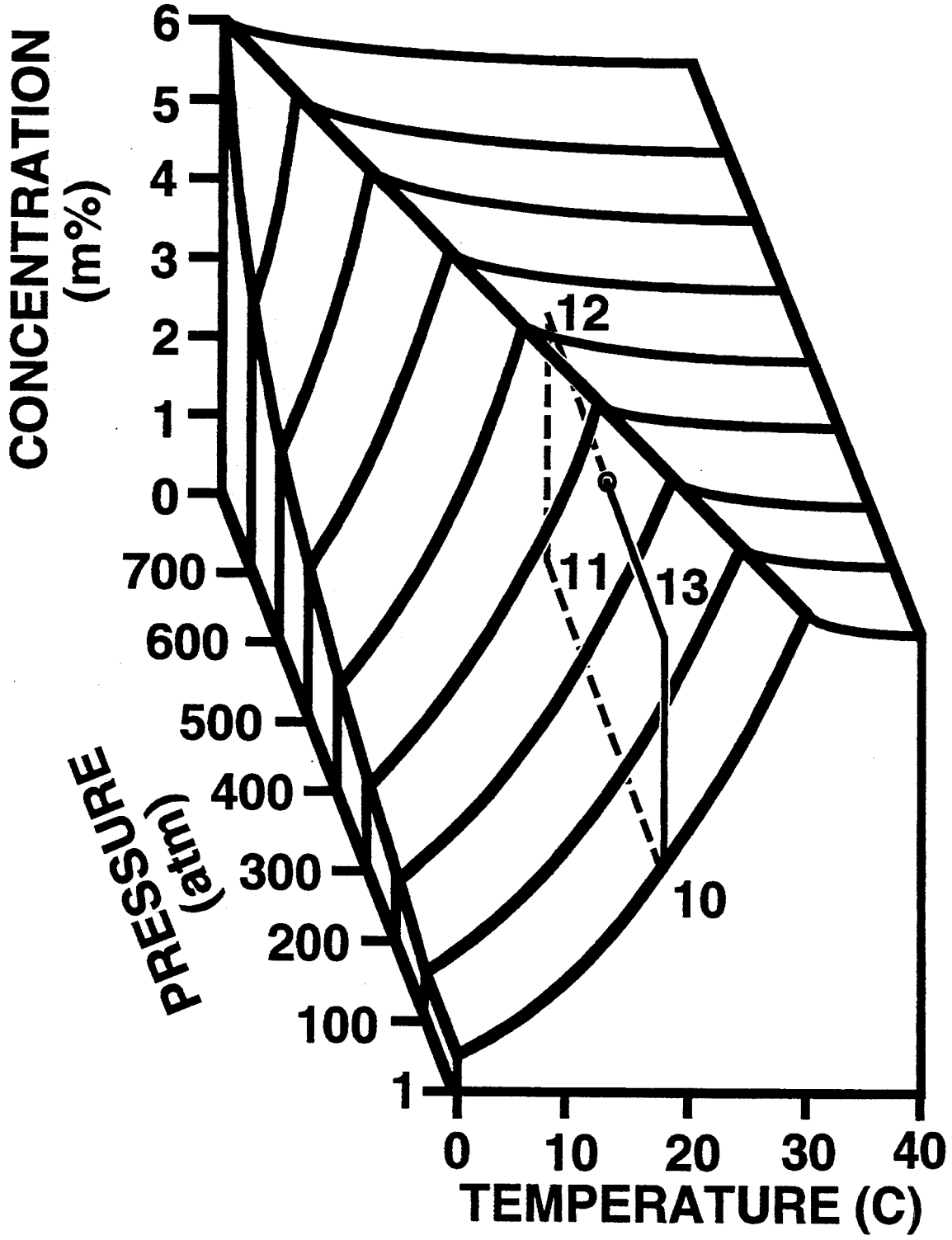
FIG. 1 is a solubility diagram for the sodium sulfate system as a function of concentration, temperature and pressure.

The series of curves shown in FIG. 1 represent the saturation surfaces for mirabilite ($Na_2SO_4 10H_2O$) and thenardite ($Na_2SO_4$), two of the solid phases of the sodium sulfate-water system (ice and heptahydrate are not shown). The series of curves that show increasing solubility with temperature and increasing solubility with pressure form the saturation surface for mirabilite. The series of curves that show decreasing solubility with temperature and decreasing solubility with pressure form the saturation surface for thenardite. The area to the right and below the combined surfaces represents undersaturated solutions, and the area above and to the left of the combined surfaces represents supersaturated solutions. The saturation surfaces represent equilibrium concentration conditions at a given temperature and pressure. This solubility diagram is based on work by Knacke and Von Edberg (1975), who described how the intersection of the mirabilite and thenardite solubility surfaces migrated with pressure, and on work by Manikhin and Kryukow (1968), who measured the variation in solubilities with pressure for the sodium sulfate system.

As shown in FIG. 1, increasing the pressure in the sodium sulfate system increases the solubility and, conversely, decreasing the pressure or applying pressures less than atmospheric pressure (not shown in FIG. 1 ) decreases the solubility. There is a volume increase in the sodium sulfate system during precipitation from a supersaturated solution and for the solution when pressure is decreased. By controlling the temperature and pressure path followed during the treatment method, the supersaturation ratios can be maximized to achieve rapid crystallization, large volume increases and high crystallization pressures.

Using pressure instead of or in combination with temperature to induce precipitation has several advantages: in practice pressure changes can be applied more rapidly than temperature changes because temperature changes result in thermal losses which often result in wasted energy or the need for insulation; repeated cycles of pressure can be applied at a given temperature to allow other advantageous chemical reactions to occur that would otherwise be adversely affected by temperature changes; increasing the pressure forces the solution into pore spaces; and creating a partial vacuum removes gases within the pore spaces which would otherwise accommodate volume increases and thereby decrease the effectiveness of the method.

In this method, the raw materials to be broken down and excess solid expansive solidifiers are placed in the vessel 1 by removing the piston 2. The piston 2 is returned to within the pressure vessel 1, and the raw materials are then saturated with a saturated solution of expansive solidifiers, applied through the solution valve 5.

Gases are removed from the vessel through the gas valve 4. Initially ambient gases that are displaced by the raw materials are removed through the gas valve 4, by displacement. However dissolved gases may be present within the solution, and gases may be present within voids of the raw materials. These gases may be removed by drawing a vacuum through the gas valve 4 to prevent the volume increases during precipitation of the expansive solidifiers from being accommodated by the highly compressible gases.

After gases are removed, the materials begin the method at atmospheric pressures (point 10 in FIG. 1). The pressures and temperatures are changed with the piston 2 and by water 6 (point 11 in FIG. 1 ) and the system is allowed to equilibrate at high solution concentrations by allowing solid expansive solidifiers to dissolve (point 12 in FIG. 1). The equilibration may be accelerated by mixing with the agitator 8. The pressures and temperatures are then changed by retracting the piston 2, opening the gas valve 4 to atmospheric pressure, or drawing a vacuum through the gas valve 4 to produce high supersaturation ratios (point 13 in FIG. 1) and eventual rapid crystallization and volume increases of the expansive solidifiers to break the raw materials down (return to point 10 in FIG. 1 ).

During the above described method, the excess solid solidifiers are first driven into solution then out of solution. When the excess solid solidifiers are driven out of solution, a volume increase occurs. This volume increase occurs wherever precipitation occurs, including within the pores and fractures of the materials being processed. The volume increase within the pores and fractures of the materials being processed causes tension in the raw materials being processed, thereby breaking apart the raw materials.

After processing, the excess expansive solidifiers can be washed from the processed materials with water 20, and the solution can be separated from the treated material by sieving or centrifuging 21, as shown in FIG. 3.

This method may be applied in-situ to host rocks to increase permeability by fracturing and disaggregating the host rock. In this application, a well bore serves as the pressure vessel, and the host rock surrounding unlined portions of the well bore are the raw materials to be comminuted. In this application it is particularly important to use a high-capacity pump 100 since pressures within the host rock will decrease with distance away from the well bore. The effectiveness of this application can be increased by several modifications of the description above, including: the use of finely-ground excess expansive solidifier in order to avoid plugging of existing pores in the host rock; pre-injecting de-gased water into the host rocks to prevent compressible gases from absorbing the volume increases of the expansive solidifiers; raising or lowering the temperatures of the host rocks nearby the well bore to enhance the dissolution or precipitation of the expansive solidifiers. After the expansive solidifiers have precipitated from solution, they can be flushed from the host rock with fresh water.

While the above description contains many specificities, these should not be construed as limitations on the scope of the invention, but rather as an exemplification of one preferred embodiment thereof. Many other variations are possible, for example, other salts and/or chemicals besides sodium sulfate may also be used; the method may be combined with other mechanical, chemical or physio-chemical methods or processes, or the salt solution may be mixed with other chemicals to combine with or enhance other physical, chemical or physio-chemical breakdown processes; the temperature and pressure path represented by points 10–13 in FIG. 1 represents one of many possible temperature and pressure paths that might be utilized with this method, and cyclic temperature and pressure changes may be used; placing seed crystals in the supersaturated solution, vibrations, achieving critical supersaturation concentrations, time, and/or other methods of initiating the crystallization may be used; many types of raw materials may be used; and many types of pressure and temperature vessels or piping systems may be used to achieve the required pressure and temperature changes. The method may also be applied in-situ to host rocks. Accordingly, the scope of the invention should be determined not by the embodiment illustrated, but by the appended claims and their legal equivalents.

I claim:

1. Method of comminuting raw materials, said method including the steps of:

(A) providing a temperature and pressure controlled vessel;

(B) placing the raw materials to be comminuted into the vessel;

(C) adding a saturated solution of expansive solidifiers, and adding additional solid expansive solidifiers in excess of that required to maintain a saturated solution at atmospheric pressure;

(D) pressurizing the vessel and maintaining pressures above atmospheric pressure to cause the excess solid expansive solidifiers to enter into solution;

(E) lowering the pressure so that the expansive solidifier solution is supersaturated with respect to the expansive solidifier;

(F) initiating rapid un-drained precipitation from a supersaturated solution and comminution of the raw materials.

2. The method according to claim 1 where step D consists of changing the temperature of the vessel to convert the excess solid expansive solidifiers into solution.

3. The method according to claim 1 including the step of changing the temperature of the vessel to convert the excess solid expansive solidifiers into solution following step D but prior to step E.

4. The method according to claim 1 where step E consists of changing the temperature of the vessel so that the expansive solidifier solution is supersaturated with respect to the expansive solidifier.

5. The method according to claim 1 including the step of changing the temperature of the vessel so that the expansive solidifier solution is supersaturated with respect to the expansive solidifier following step D.

6. The method according to claim 1 where step F consists of lowering the pressure to drive the supersaturated expansive solidifier solution to become critically supersaturated initiating rapid un-drained precipitation from a supersaturated solution and comminution of the raw materials.

7. The method according to claim 1 where step F consists of drawing a vacuum to drive the supersaturated expansive solidifier solution to become critically supersaturated initiating rapid un-drained precipitation from a supersaturated solution and comminution of the raw materials.

8. The method according to claim 1 where step F consists of changing the temperature to drive the supersaturated expansive solidifier solution to become critically supersaturated initiating rapid un-drained precipitation from a supersaturated solution and comminution of the raw materials.

9. The method according to claim 1 where step F consists of adding a seed crystal to the supersaturated expansive solidifier solution initiating rapid un-drained precipitation from a supersaturated solution and comminution of the raw materials.

10. The method according to claim 1 where step F consists of vibration of the supersaturated expansive solidifier solution to initiate rapid un-drained precipitation from a supersaturated solution and comminution of the raw materials.

11. The method according to claim 1 further including the step of drawing a vacuum to the raw materials between steps C and D.

12. The method according to claim 1 of repeating steps D through F one or more times.

13. The method according to claim 1 including the step of agitating the raw materials and excess solid expansive solidifiers following step C but prior to step E.

14. The method according to claim 1 where step B consists of placing cellulose into the vessel.

15. The method according to claim 1 where step B consists of placing coal into the vessel.

16. The method according to claim 1 where step B consists of placing mineral ore into the vessel.

17. The method according to claim 1 further including the step of agitating the mixture after step D.

18. The method according to claim 1 further including the step of raising the temperature after step D.

19. The method according to claim 1 further including the step of lowering the temperature after step D.

20. The method according to claim 1 where step F consists of lowering the pressure to initiate rapid un-drained precipitation from a supersaturated solution and comminution of the raw materials.

21. The method according to claim 1 where step F consists of lowering the temperature to initiate rapid un-drained precipitation from a supersaturated solution and comminution of the raw materials.

22. The method according to claim 1 where step F consists of raising the temperature to initiate rapid un-drained precipitation from a supersaturated solution and comminution of the raw materials.

23. The method according to claim 1 where step F consists of adding a seed crystal to the expansive solidifier solution to initiate rapid un-drained precipitation from a supersaturated solution and comminution of the raw materials.

24. The method according to claim 1 where step F consists of vibrating the expansive solidifier solution to initiate rapid un-drained precipitation from a supersaturated solution and comminution of the raw materials.

25. Method of comminuting raw materials, said method including the steps of:

(A) providing a temperature controlled vessel;

(B) placing the raw materials to be comminuted into the vessel;

(C) adding a saturated solution of expansive solidifiers, and adding additional solid expansive solidifiers in excess of that required to maintain a saturated solution at atmospheric pressure;

(D) heating the vessel and maintaining temperatures above the initial temperature to cause the excess solid expansive solidifiers to enter into solution;

(E) lowering the temperature so that the expansive solidifier solution is supersaturated with respect to the expansive solidifier;

(F) initiating rapid un-drained precipitation from a supersaturated solution and comminution of the raw materials.

26. The method according to claim 25 where step F consists of applying a vacuum to initiate rapid un-drained precipitation from a supersaturated solution and comminution of the raw materials.

27. The method according to claim 25 where step F consists of adding a seed crystal to initiate rapid un-drained precipitation from a supersaturated solution and comminution of the raw materials.

28. The method according to claim 25 where step F consists of vibration of the expansive solidifier solution to initiate rapid un-drained precipitation from a supersaturated solution and comminution of the raw materials.

29. The method according to claim 25 where step F consists of agitation of the expansive solidifier solution to initiate rapid un-drained precipitation from a supersaturated solution and comminution of the raw materials.

30. The method according to claim 25 of repeating steps D through F one or more times.

31. The method according to claim 25 where step B consists of placing cellulose into the vessel.

32. The method according to claim 25 where step B consists of placing coal into the vessel.

33. The method according to claim 25 where step B consists of placing mineral ore into the vessel.

34. The method according to claim 1 further including the step of agitating the mixture after step D.

35. The method according to claim 34 further including the step of raising the temperature of the solution before step E.

36. The method according to claim 35 further including the step of lowering the temperature of the solution before step F.

37. The method according to claim 36 further including the step of adding a seed crystal to initiate rapid un-drained precipitation from a supersaturated solution and comminution of the raw materials.

38. The method according to claim 36 further including the step of vibrating the mixture to initiate rapid un-drained precipitation from a supersaturated solution and comminution of the raw materials.

39. Method of fracturing, disaggregating and increasing the permeability of a host rock including the steps of:

(A) applying a saturated solution of expansive solidifiers, and adding additional finely-ground solid expansive solidifiers in excess of that required to maintain a saturated solution at atmospheric pressure;

(B) pressurizing the mixture within the host rock and maintaining pressures above atmospheric pressure to cause the excess solid expansive solidifiers to enter into solution and to flow into the host rock;

(C) lowering the pressure so that the expansive solidifier solution is supersaturated with respect to the expansive solidifier;

(D) initiating rapid un-drained precipitation from a supersaturated solution and comminution of the host rock;

(E) flushing of the expansive solidifiers from the host rock.

40. The method according to claim 39 further including the step of raising the temperature of the host rock prior to step A.

41. The method according to claim 39 further including the step of lowering the temperature of the host rock prior to step A.

42. The method according to claim 39 of repeating steps A through E one or more times.

* * * * *